United States Patent [19]

Vigreux

[11] Patent Number: 4,624,075

[45] Date of Patent: Nov. 25, 1986

[54] FITTING FOR A TWO-WAY OPENING WINDOW WITH MEANS FOR LOCKING THE WINDOW IN ONE DIRECTION

[75] Inventor: Daniel Vigreux, Hartzviller, France

[73] Assignee: Ferco International Usine de Ferrures de Batiment, Sarrebourg, France

[21] Appl. No.: 690,465

[22] Filed: Jan. 10, 1985

[30] Foreign Application Priority Data

Jan. 25, 1984 [FR] France ..... 84 01238
Jan. 31, 1984 [FR] France ..... 84 01586

[51] Int. Cl.[4] ..... E05D 15/52
[52] U.S. Cl. ..... 49/192
[58] Field of Search ..... 49/192, 394

[56] References Cited

U.S. PATENT DOCUMENTS 4,420,905 12/1983 Kucharczyk ..... 49/192

FOREIGN PATENT DOCUMENTS 2600307 7/1977 Fed. Rep. of Germany ..... 49/192
3307209 9/1984 Fed. Rep. of Germany ..... 49/192

*Primary Examiner*—Kenneth Downey
*Attorney, Agent, or Firm*—Robert E. Burns; Emmanuel J. Lobato; Bruce L. Adams

[57] ABSTRACT

This fitting for two-way opening windows or French-windows is adapted to be operated by means of a single handle for imparting to the fitting a locked position and two opening positions; the fitting is disposed between the fixed frame and the movable frame of the window and comprises on the one hand at least one locking member rigid with a control rod disposed on one of the frames and adapted to be moved through a distance corresponding to two successive pitches by actuating the handle, and on the other hand at least one keeper engageable by the locking member and disposed on the other frame, this keeper comprising locking means of which one component, the locking member or the keeper, is movable through a distance corresponding to one pitch of the movement performed by the control rod in the direction of travel thereof.

24 Claims, 28 Drawing Figures

FITTING FOR A TWO-WAY OPENING WINDOW WITH MEANS FOR LOCKING THE WINDOW IN ONE DIRECTION

BACKGROUND OF THE INVENTION

The present invention relates to a fitting for window or French-window of the type adapted to be operated by means of a single handle permitting of positioning the fitting in a locked position and two opening positions, this fitting disposed between the fixed frame and the movable frame of the window being provided with at least one locking member rigid with an operating rod disposed on one of the frames and adapted to be moved through a distance corresponding to two successive pitches by means of the handle, and with a keeper engageable by the locking member and provided on the other frame.

THE PRIOR ART

Fittings for swinging windows or French-windows adapted to be operated by means of a single handle are already known in the art. They can be set in three positions, namely:

- a first position in which the movable frame is locked in its closed position;
- a second position permitting the so-called 'French' opening of the movable frame by causing the frame to pivot about a vertical axis, and
- a third position permitting the so-called 'bellows' opening of the movable frame by pivoting same about a horizontal axis.

A single handle actuates a control rod provided with at least one locking member. Any change of one-quarter of a revolution of the handle position is attended by an axial translation of the control rod through a predetermined stroke referred to herein as one 'pitch'. The assembly comprising the handle, control rod and locking member is rigid with one of the frames, preferably the movable or opening frame, of the window. The locking member is adapted of course to engage a keeper rigid with the other frame.

When windows or French-windows adapted to pivot about a vertical axis and a horizbntal axis are installed in public premises such as schools, hospitals and other buildings, they must meet strict safety regulations. Thus, notably, the windows and French-windows must be provided with means for preventing the opening of the window by pivoting same about a vertical axis, for obvious safety reasons, that is, preventing any fall of persons and/or objects through the window.

However, for manufacturers of windows and French-windows of this type, these safety regulations are attended by various problems. Thus, two series of fittings must be provided, one series being intended for windows and French-windows subjected to said safety regulations, thus increasing considerably the manufacturing cost. On the other hand, it may happen that for any reason already installed windows and/or French-windows will have to be subjected to these safety regulations.

As a consequence of the linear translation of the locking member, the movable frame is prevented from opening by pivoting about a vertical axis. Thus, a certain degree of safety is imparted by the fitting of the present invention to the window or French-window, notably against any fall of persons or objects through the window or French-window.

However, after the linear movement of translation of the locking member rigid with the operating rod, the window or French-window must necessarily preserve its position preventing the opening of the movable frame by pivoting about a vertical axis. In fact, the user must be protected against any error for the risk of fall of persons or objects through the window or French-window would be aggravated if, for any reason, this locking feature were eliminated and the window or French-window would again be openable in both directions.

SUMMARY OF THE INVENTION

It is the primary object of the present invention to avoid the above-described inconveniences by providing an improved fitting for windows and French-windows which can be operated by means of a single handle in order to set the movable window frame in a closed and locked position and two opening positions, this fitting, disposed between the fixed frame and the movable frame, being provided with at least one locking member rigid with a control rod disposed on one of the frames and adapted to be moved through a distance corresponding to two successive pitches by means of said handle, and at least one keeper provided on the other frame and engageable by the locking member, the fitting according to the instant invention comprising on the one hand a locking point of which one of the members (locking member or keeper) is movable through the distance of one pitch of said control rod in the direction of travel of the rod and, on the other hand, a safety device adapted to lock said locking member at the end of its linear translation.

The advantageous features characterizing this invention lie essentially in the fact that it permits on the one hand of converting existing fittings already installed on windows and French-windows into fittings in conformity with safety regulations, and on the other hand of limiting the manufacture of fittings to a single series adapted to be used either as normal fitting and/or as fittings positively preventing the opening of the movable frame in one direction.

THE DRAWINGS

FIG. 1 is a front elevational view showing a window adapted to pivot about a vertical or horizontal axis and provided with means for locking the window frame against opening in one direction, according to the teachings of the present invention;

FIG. 2 is a fragmentary sectional view showing on a larger scale the position of the locking means in the case of the normal operation of a window or French-window adapted to pivot about a vertical or horizontal axis, and the three positions of the locking member when the movable frame is locked or can be opened by pivoting about a vertical axis or a horizontal axis, the component elements of said locking means corresponding to a first form of embodiment;

FIG. 12 shows in side elevational view the locking means of the fitting in the unlocked or release position which permits the opening of the movable frame by pivoting about a vertical axis;

FIG. 13 shows in side elevational view the same locking means, with the locking member shifted by translation through the distance of one 'pitch' for positively preventing the opening of the movable frame by pivoting about a vertical axis;

FIG. 14 shows in elevational and sectional view the locking means, with the fitting in the position permitting the opening of the window frame by pivoting about a horizontal axis, the locking member being in its release position after locking the movable frame for preventing the opening thereof by pivoting about a vertical axis;

FIG. 15 is a side elevational view showing this locking member in the fitting position shown in FIG. 12;

FIG. 16 is a side elevational view showing the locking member in the fitting position shown in FIG. 13;

FIG. 17 is a part-sectional and side elevational view, the section being taken along the line XVII—XVII of FIG. 14;

FIG. 18 is a cross-sectional view taken substantially along the line XVIII—XVIII of FIG. 16, and FIG. 19 is a plan and cross-sectional view taken along the line XIX—XIX of FIG. 17;

FIG. 20 is a part-sectional, part-elevational view of the locking means, showing the locking member in its release position permitting the opening of the movable frame by pivoting about a vertical axis;

FIG. 21 is a part-sectional, part-elevational view of the locking means showing the locking member after its one-pitch translation for positively locking the movable frame against opening by pivoting about a vertical axis;

FIG. 22 illustrates in part-sectional, part-elevational view the locking means, the fitting being shown in its open position after pivoting the window frame about a horizontal axis, the locking member being shown in its release position after locking the movable frame against opening by pivoting about a vertical axis;

FIG. 23 is a side elevational view showing the locking member in the fitting position shown in FIG. 20;

FIG. 24 illustrates in side elevational view the same locking member in the fitting position of FIG. 21;

FIG. 25 is a part-sectional, part-elevational view, the section being taken along the line XXV—XXV of FIG. 22;

FIG. 26 is a cross-section taken along the line XXVI—XXVI of FIG. 24;

FIG. 27 is a part-sectional view, the section being taken along the line XXVII—XXVII of FIG. 25.

DESCRIPTION OF THE PREFERRED EMBODIMENTS

Figure 1:
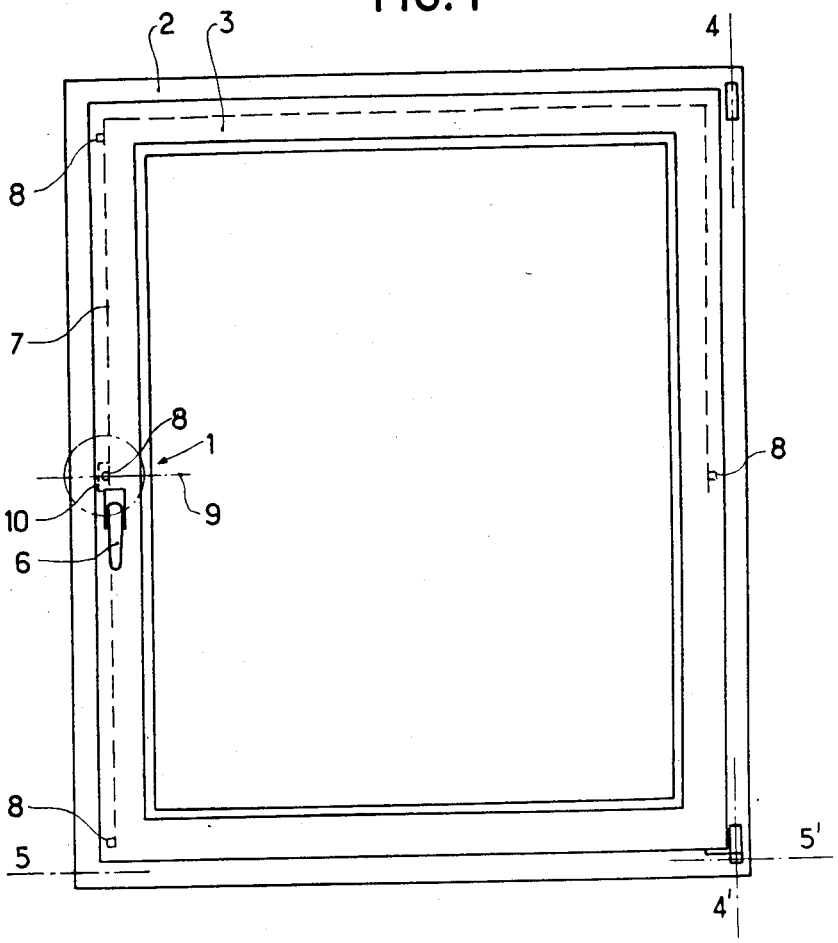

Referring first to FIG. 1 of the drawings, the window fitting according to the present invention is disposed between the fixed frame 2 and the movable frame 3 of the window or French-window. The movable frame 3 is adapted to be opened by pivoting either about a vertical axis 4–4', or about a horizontal axis 5–5'. This fitting 1 is adapted to be operated by means of a single handle 6 operatively connected to a control rod 7 comprising at least one locking member 8 constituting one of the component elements of locking means 9. This locking member 8 is adapted to cooperate with a keeper 10 constituting the other component element of locking means 9 for setting the movable frame 3 either in a locked position or in a position positively preventing the opening of the movable frame by pivoting same about a vertical axis, or still in a position permitting the opening of the movable window frame by pivoting same about a horizontal axis. By actuating the single handle 6 the control rod 7 can be moved linearly through a distance divided into two pitches, steps or sections, the first pitch restoring the locking member 8 of locking means 9 from the position in which the movable window frame 3 is locked to the position in which the same window frame 3 is openable by pivoting about a vertical axis. Arbitrarily, the single handle 6, control rod 7 and locking member 8 are mounted to the movable frame 3 and the keeper 10 is rigid with the fixed frame 2. Of course, it would not constitute a departure from the basic principles of the present invention to fix the keeper 10 on the movable frame 3 and to fit the assembly comprising the single handle 6, control rod 7 and locking member 8 on the fixed frame 2.

To obtain the result sought according to the primary object of the present invention, that is, locking the movable window frame 3 against opening by pivoting about a vertical axis, the locking means 9 are shifted through a distance corresponding to one pitch or step of control rod 7, in other words by moving one element 8 or the other element 10 of the two component elements of said locking means 9. For this purpose, the cooperation between these two elements 8, 10 of locking means 9 is maintained by causing the keeper 10 to prevent the transverse movement of locking member 8.

To simplify the drawings and the following description, the various FIGS. 2–11 of the drawings illustrate the basic principle of operation of the invention by showing only the locking means and the relative positions of the component elements of said locking means.

Figure 2:
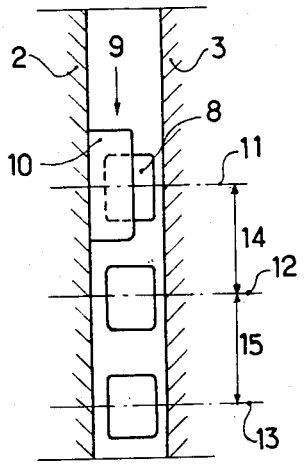
Figure 3:
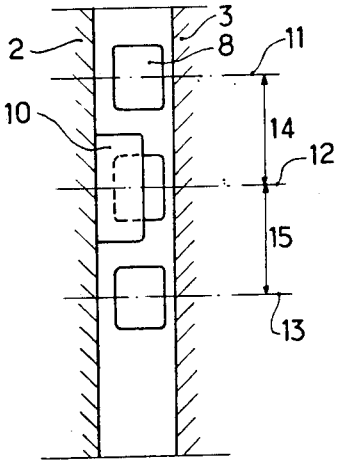
FIG. 3 illustrates the position of the locking area when the opening of the movable window frame by pivoting same about a vertical axis is positively prevented by the locking member shown in its three positions.

Referring now to FIGS. 2 and 3 of the drawings, the locking means 9 comprise the locking member proper 8 disposed on the movable window frame 3 and the keeper 10 rigid with the fixed frame 2. The dash and dot lines 11, 12 and 13 designate the locking position of the movable frame 3, the opening of the movable frame 3 by pivoting about a vertical axis and the opening of the movable frame 3 by pivoting about a horizontal axis, respectively. The pitch between the locking position and the opening position of the movable frame by pivoting about a vertical axis is designated by reference numeral 14, and the pitch between the open position obtained by pivoting about a vertical axis and the open position obtained by pivoting about a horizontal axis is designated by reference numeral 15.

As shown in FIG. 2, the locking means is in the locking position 11 of movable frame 3 and a mutual engagement is obtained between the locking member 8 and keeper 10, so that the movable frame 3 is in its locked condition. If this mutual engagement is discontinued, that is, when locking member 8 has been moved through one pitch 14 and registers with dash and dot line 12, the fitting permits the opening of the movable frame 3 by pivoting this frame about a vertical axis, and if it registers with dash and dot line 13, the fitting permits of opening this movable frame 3 by pivoting about a horizontal axis. For this purpose, the locking member 8 must be moved through the extent of one pitch 15.

As shown in FIG. 3, when from this position, corresponding to the opening of the window frame by pivoting about a horizontal axis, one or the other element of locking means 9 is shifted by the value of one pitch, the locking point is at level 12 of FIG. 2. When the locking member 8 or the keeper 10 registers with this position 12, the movable frame 3 is locked against any pivotal opening movement about a vertical axis and it will be necessary to shift the locking member 8 by one pitch 15 for obtaining the opening of the movable frame 3 by pivoting same about a horizontal axis. When the locking member 8 is restored to position 11, the other locking elements reinforce the locking of the movable frame.

Figure 4:
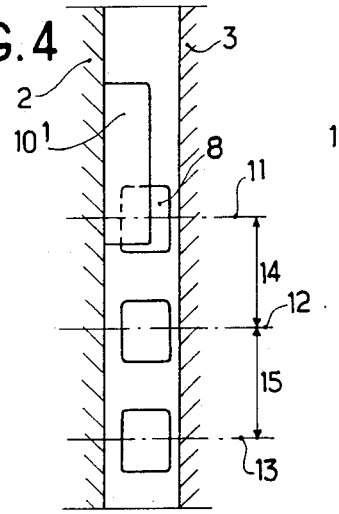
FIG. 4 shows the position of the locking means in the case of the normal operation of the window or French-window opening in two directions, and the three positions of the locking member when the movable frame is locked or can be opened by pivoting about a vertical or horizontal axis, the keeper corresponding to a second form of embodiment.
Figure 5:
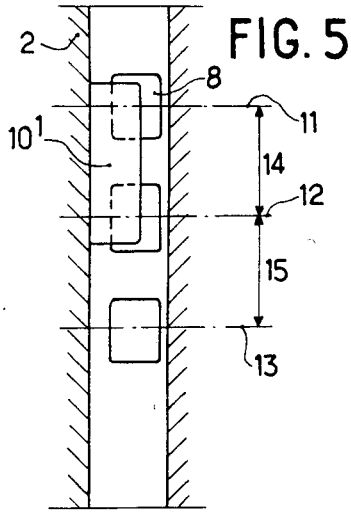
FIG. 5 illustrates the position of the locking means when the movable window frame is locked against opening by pivoting about a vertical axis, the locking member being shown in its three positions, the keeper being the same as the one shown in FIG. 4.

According to another form of embodiment illustrated in FIGS. 4 and 5, the length of keeper $10_1$ exceeds that of pitch 14. Thus, in FIG. 4, the same principle as depicted with reference to FIG. 2 is observed. However, by shifting one or the other element of locking means 9 to position 12 of FIG. 4, the movable frame 3 will not only be locked in the position corresponding to the opening thereof by pivoting about a vertical axis but also in a positively locked position. It is only when the locking member 8 registers with position 13 of FIG. 5 that the movable window frame 3 can be opened by pivoting about a horizontal axis.

Figure 6:
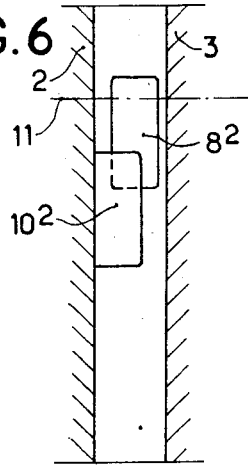
FIG. 6 shows the position of two component elements (keeper and locking member) of the locking means, when the window frame is in its locked condition, both elements constituting a third form of embodiment of the invention.
Figure 7:
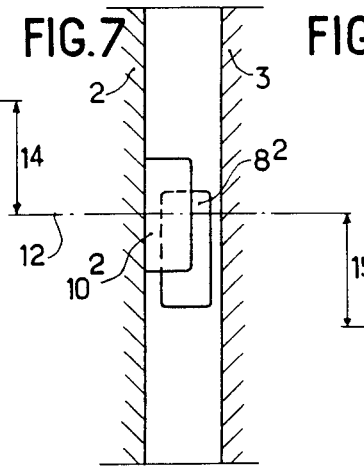
FIG. 7 illustrates the position of the same component elements as in FIG. 6 when the window can be opened by pivoting the movable frame about a vertical axis.
Figure 8:
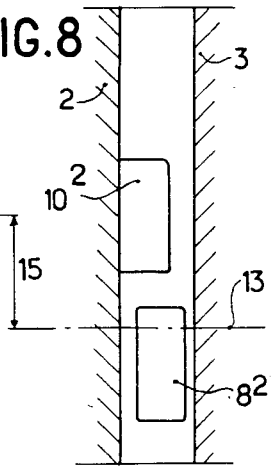
FIG. 8 shows the position of the component elements of FIGS. 6 and 7 when the movable frame is opened by pivoting about a horizontal axis.

Referring now to FIGS. 6–8 of the drawings, instead of changing the position of anyone of the two elements of said locking means 9, the lengths of keeper $10_2$ and locking member $8_2$ are so calculated that the cooperation between these two members is maintained even if the locking means 9 are shifted from position 11 to position 12.

As already mentioned hereinabove, the transposition can also be made by either shifting the locking member 8 along rod 7 or shifting the position of keeper 10 on the fixed frame of the window.

Figure 9:
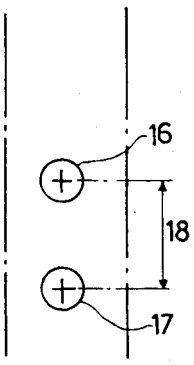
FIG. 9 illustrates diagrammatically the movement by transposition of the position of one of the component element of the locking means.

In FIG. 9, the transposition is obtained by providing two fixing recesses 16, 17 either in the control rod 7 for transposing the locking member 8 or in the fixed frame for transposing the keeper 10. The distance 18 between these recesses 16, 17 corresponds to pitch 14 or 15.

Figure 10:
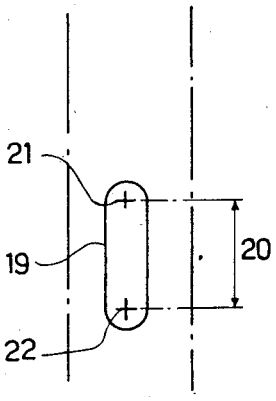
FIG. 10 illustrates diagrammatically the movement, by linear translation, of the position of one of the component elements in the locking area.

In a modified form of embodiment shown in FIG. 10, the transposition of one elements 8 or 10 is obtained by linear translation. For this purpose, an elongated hole 19 is provided and the distance 20 between the two end positions 21 and 22 corresponds to pitch 14 or 15.

Figure 11:
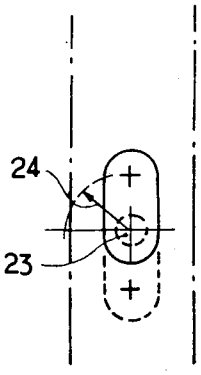
FIG. 11 illustrates diagrammatically the movement by rotation, of the position of one of the component elements of the locking means.

In another possible form of embodiment of the invention, as illustrated in FIG. 11, the transposition of one of said elements 8 or 10 is obtained by rotating this element through 180 degrees about an axis 23. The radius of this rotation corresponds to a half-pitch 14 or 15. The axis 23 is eccentric by a half-pitch movement 14 or 15 accomplished by control rod 7.

Referring now to FIGS. 12–19 of the drawings, the fitting comprises, according to the present invention, at least one set of locking means 9 comprising each a keeper 10 cooperating with a locking member 8. The keeper 10 is rigid with the edge 25 of a metal frame constituting for example the fixed frame 2 of the two-way opening window or French-window, said keeper 10 projecting from said edge 25. The locking member 8 is rigid with an intermediate control rod 7 interposed between two control-rod sections 26 and 27 adapted to be actuated by the handle (not shown). This intermediate control rod 7 and the control-rod sections 26 and 27 are slidably mounted in a groove 28 formed in the edge of the movable frame 29 of the window or French-window. For operatively interconnecting the two sections 26, 27 and the intermediate control rod 7, the latter comprises on the one hand at its lower end 30 an orifice 31 engaged by a stud 32 projecting from the rear face 33 of an offset portion 34 formed integrally at the upper end 35 of control-rod section 27, and on the other hand, at its upper end 36 a stud 37 projecting from the rear face 38 of another offset portion 39 formed in said upper end 36. This stud 37 engages an orifice 40 formed in the lower end 41 of control-rod section 26.

The intermediate control rod 7 comprises in its rear face 42 a longitudinal groove 43 acting as a means for guiding and housing a slide 44. This slide 44 is rigidly connected to locking member 8. The locking member 8 extends through a longitudinal slot 45 of which the longitudinal axis 46 is coplanar with the longitudinal axis 47 of intermediate control rod 7. Two holes 48, 49 having a distance between centres 50 corresponding to the shifting by one pitch 14, 15 of control rod 7, 26, 27 actuated by the handle are formed in said longitudinal slot 45. These holes 48, 49 have a substantially circular configuration and a diameter 51 somewhat greater than the width 52 of longitudinal slot 45. Each segment of a circle 53, 54, 55, 56 of said holes 48, 49 comprises a stop-forming shoulder 57, 58, 59, 60, at diametrally opposed locations, as shown. These shoulders 57, 58, 59, 60 comprise a wall portion 61, 62, 63, 64 parallel to the transverse diameter 65, 66 of holes 48, 49.

In the rear face 67 of locking member 8 a recess 68 is formed (FIG. 14) for receiving a safety device consisting essentially of a safety bolt 69. This safety bolt 69 is adapted to rotate freely in relation to locking member 8 but is rigidly connected for translation therewith through the medium of slide 44. This safety bolt 69 comprises in the front face 70 of a body 71 a groove 72. This body 71 further comprises a flat-faced portion 73 having rounded ends 74, 75 adapted to move concentrically in relation to pairs of segments of a circle 53, 54, 55, 56 of holes 48, 49. The diameter of these rounded ends 74, 75 corresponds to the diameter 51 of holes 48 and 49. The width 76 of the flat-faced portion 73 corresponds to the width 52 of the longitudinal slot 45 formed in the intermediate control rod 7, thus permitting the translation of said safety bolt 69 and consequently of locking member 8. Both faces 77, 78 of this flat-faced portion 73 are adapted to abut the walls 61, 62, 63, 64 of stop shoulders 57, 58, 59, 60 of said holes 48 and 49. Thus, the rotation of bolt 69 is limited and the flat-faced portion 73 is safely kept in a position perpendicular to the longitudinal axis 46 of longitudinal slot 47.

Access to this safety bolt 69 is made possible by the provision, in the front face 79 of locking member 8, of a slot 80 identical with the groove 72 of said safety bolt 69. On the other hand, a hole 81 is formed in slot 80, the diameter of this hole 81 being greater than the width 82 of slot 80 but smaller than the length 83 of said slot.

Figure 28:
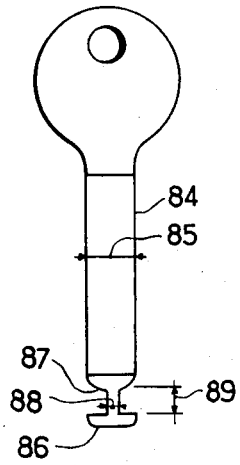
FIG. 28 is a plane view showing the member controlling the safety device.
Figure 26:
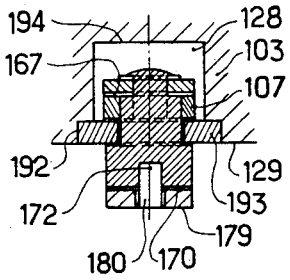
Figure 27:
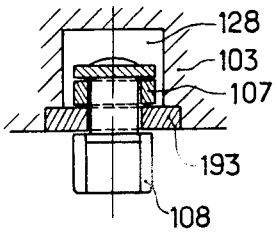

To actuate the safety bolt 69 a control member 84 (FIG. 28) is used. This control member 84 is substantially key-like. By using this control member 84 it is possible to convert the locked condition of safety bolt 69 into a release position, or vice-versa, to permit the movement of translation of locking member 8. The width 85 of this control member 84 corresponds to the length 83 of slot 80, and its thickness is subordinate to the width 82 of slot 80. A constriction 87 is formed in the outer end of this control member 84 and the width 88 of this constriction 87 is slightly greater than the thickness 90 measured between the recess 68 and the front face 79 of locking member 8.

Reference will now be made to FIGS. 20–27. The fitting illustrated in these FIGS. 20–27 is intended for a two-way opening window or French-window of wood or plastic material. It comprises at least one set of locking means 109 consisting of a keeper 110 housed in a notch 191 formed in the edge 25 of the fixed frame 102 of the window, and of a locking member 108 rigid with an intermediate control rod 107 interconnecting two sections 126, 127 of a control rod which are actuated by means of a single handle (the upper control-rod section 126 and the handle are not shown). The assembly of control rods 107, 126, 127 is slidably mounted in a groove 128 formed in the edge 129 of the movable frame 103 of the window or French-window. In the same edge 129 a second groove 192 of a width greater than that of groove 128 is formed and adapted to receive a head member 193 kept by liners 195 at a proper distance from the bottom 194 of groove 128. The intermediate control rod 107 and the two upper and lower control-rod sections 126, 127 may be interconnected by means either similar to those described hereinabove or comprising coupling sleeves 196 connected to an offset portion 134 formed at the ends 135 of said control-rod sections 126 and 127. These coupling sleeves 196 have a U-shaped cross-sectional configuration, and the inner surfaces of their lateral wings are provided with teeth 197 meshing with matching teeth 198 formed on the ends 130 of the intermediate control rod 107. This intermediate control-rod 107 comprises in the areas of liners 195 apertures 199 permitting the passage of said liners, respectively. On the other hand, the head member 193 further comprises in the area of locking means 109 an aperture 200 permitting the passage of locking member 108. Disposed between the bottom 194 of groove 128 and the rear surface 142 of intermediate control-rod 107 is a slide 144 rigidly connected to locking member 108. In the intermediate control-rod 107 a longitudinal slot 145 is formed in which two holes 148, 149 are formed, the distance between centres 150 of these holes corresponding to a one-pitch movement of the set of rods 107, 126, 127. The diameter 151 of these holes 148, 149 is greater than the width 152 of longitudinal slot 145. Each hole 148, 149 has diametrically opposed edges 157, 158 and 159, 160 having a wall 161, 162, 163, 164 parallel to the axes 165, 166 perpendicular to the diameters 146 of said longitudinal slot 145. These edges 157, 158, 159, 160 act as stop means to both faces 177, 178 of a flat-faced portion 173 of a safety bolt 169. This safety bolt 169 is located in a recess 168 formed in the rear face 167 of locking member 108. The safety bolt 169 has formed in its front face 170 a groove 172 having its longitudinal axis perpendicular to the longitudinal axis of said flat-faced portion 173. This groove 172 registers with a slot 180 formed in the front face 179 of locking member 108. This slot 180 permits in turn the passage of the end portion 86 of said control member or key 84.

OPERATION

Figure 12:
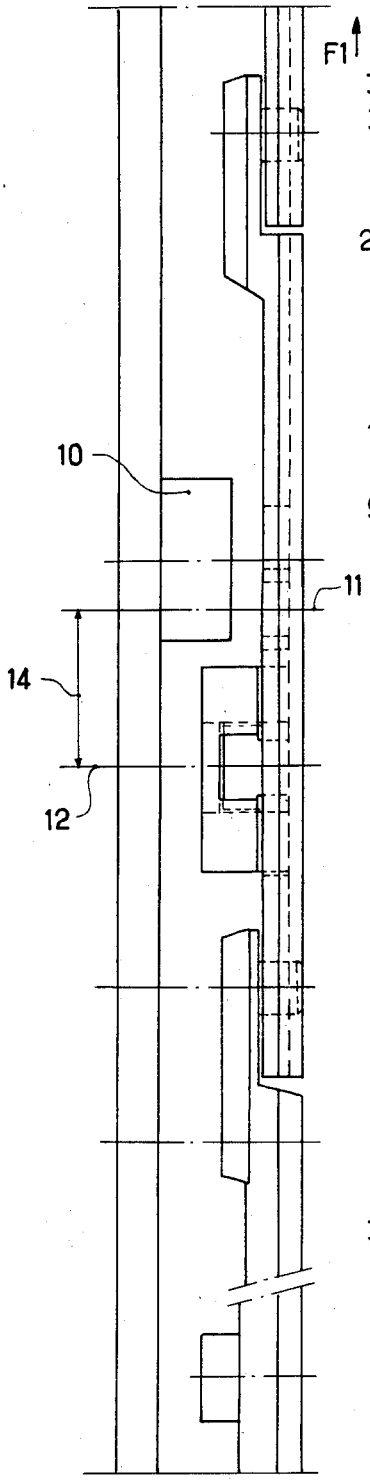
FIGS. 12–19 are diagrammatic views showing a fitting according to the present invention according to a first form of embodiment, intended for a window or French-window frame consisting of extruded metal sections, and more particularly.
Figure 20:
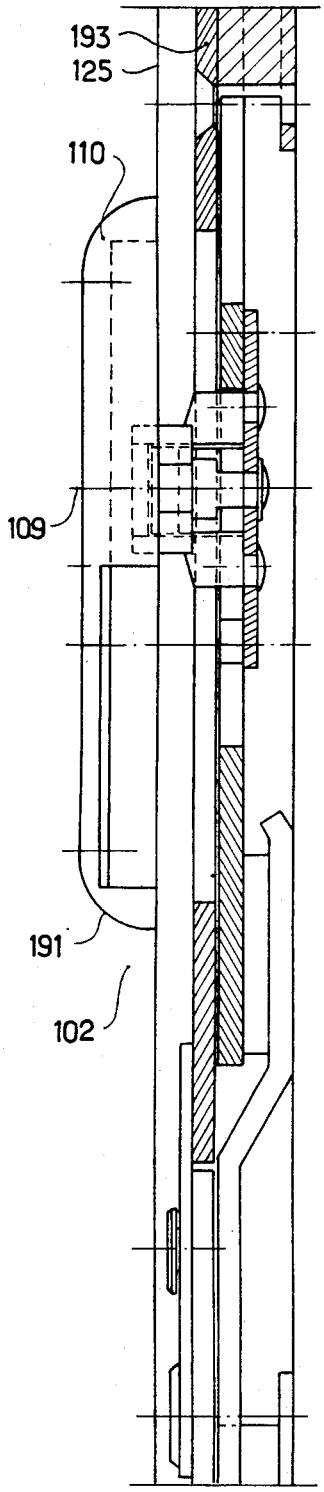
FIGS. 20–27 illustrates a fitting according to a second form of embodiment of this invention, designed for a window or French-window frame of wood and/or plastic material, and more particularly.
Figure 21:
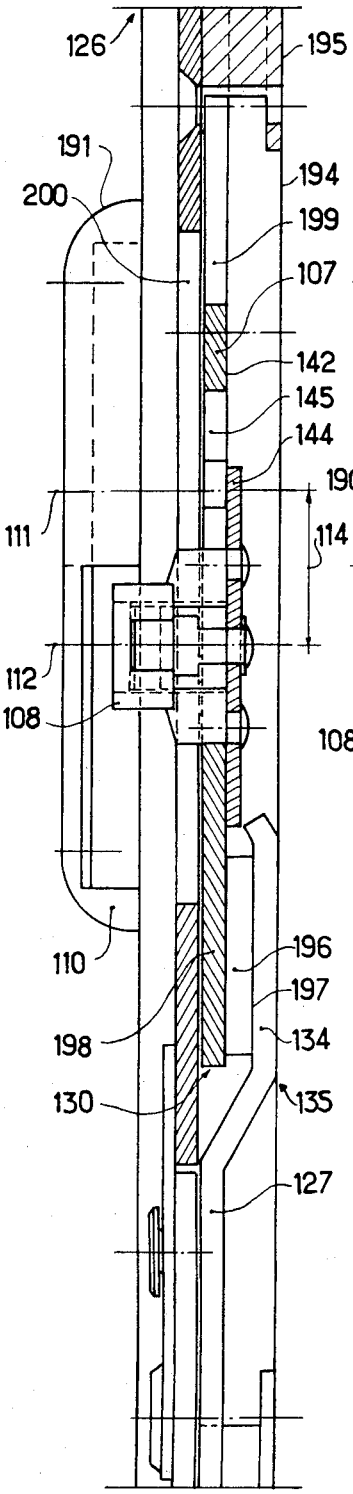
Figure 22:
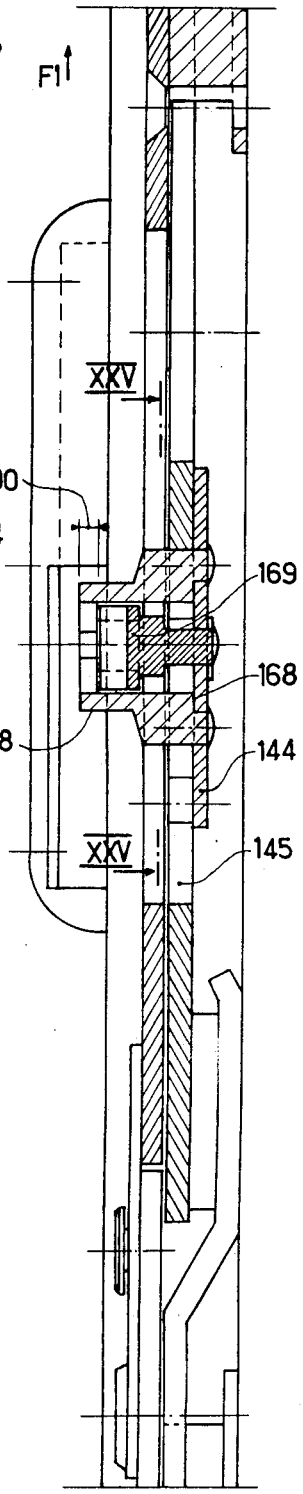

The two forms of embodiment of the window fitting of the present invention operate in the same manner, as follows:

It is assumed that the movable frame of the window or French-window is adapted to open by pivoting either about a vertical axis or about a horizontal axis and that, as shown in FIGS. 12 and 20, the locking member 8, 108 is in position 12, 112 permitting the opening of the window or French-window by pivoting its movable frame about a vertical axis.

Figure 15:
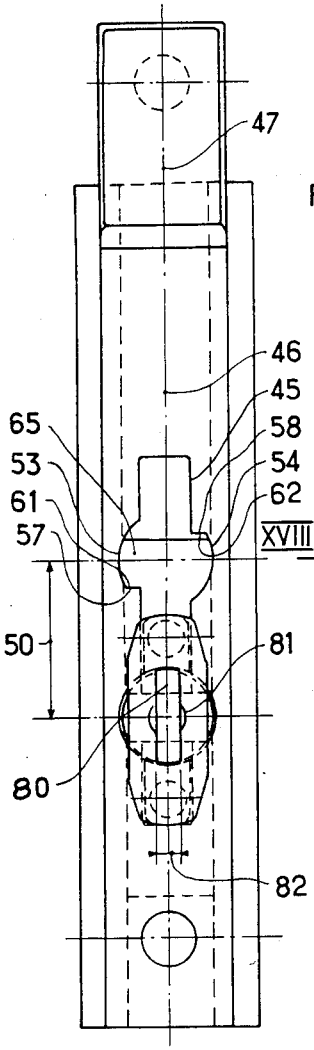
Figure 16:
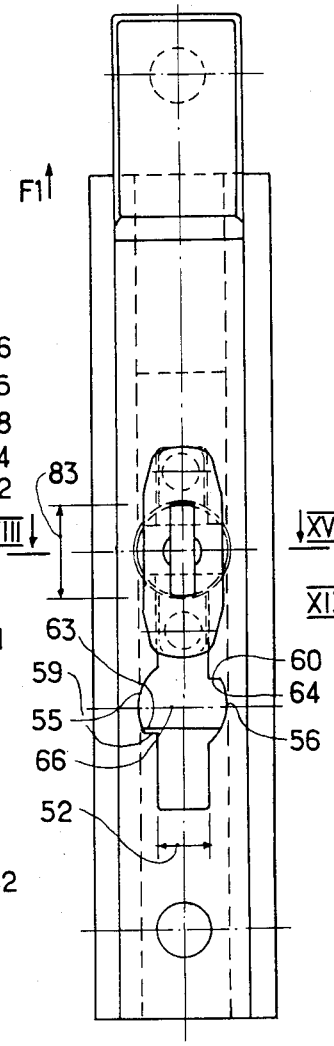
Figure 17:
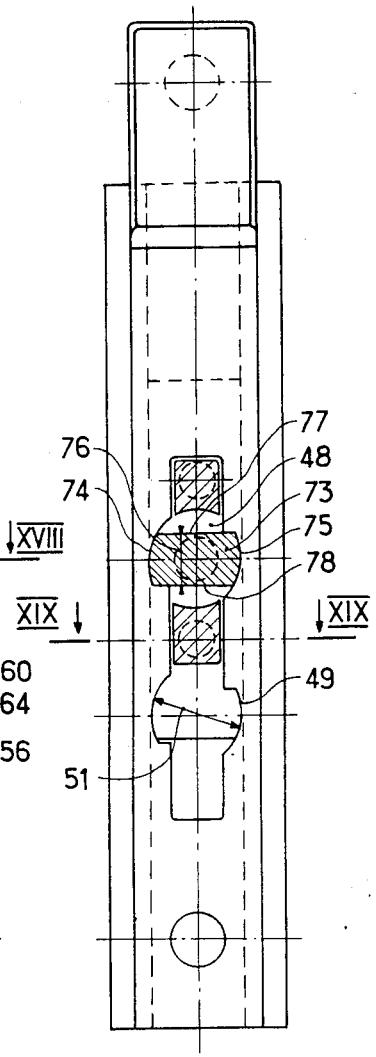
Figure 18:
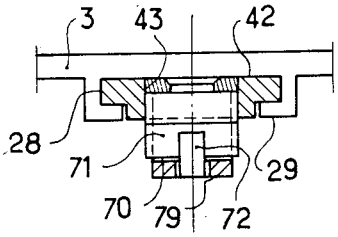
Figure 19:
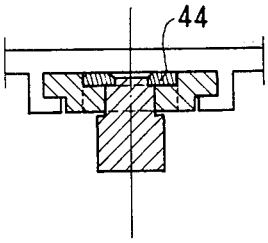
Figure 23:
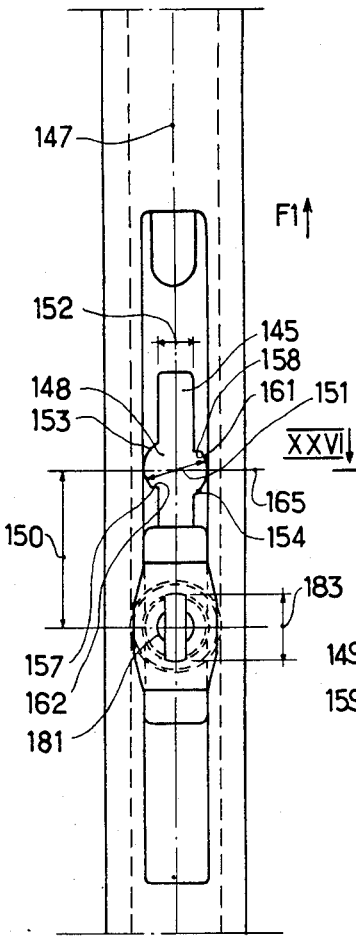
Figure 24:
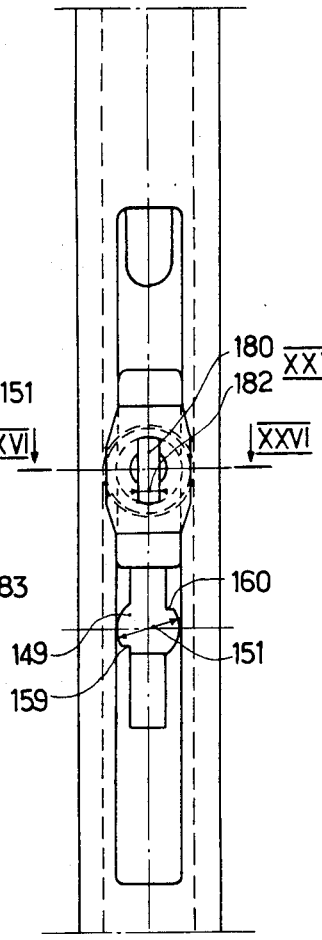
Figure 25:
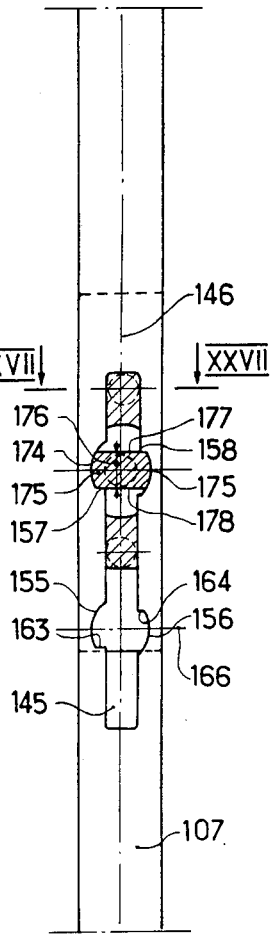

By rotating the control handle through one-quarter of a revolution, the operator causes a tractive effort to be exerted on the set of control rods 7, 26, 27 or 107, 126, 127. This assembly is moved to the extent of one pitch 14, 114 in the direction of the arrow $F_1$, so that the locking member 8, 108 is moved to its locking position 11, 111 by engaging the keeper 10, 110. Thus, the movable frame 3, 103 cannot be opened by rotating about a vertical axis or a horizontal axis. This locking member 8, 108 is in its lower position in relation to the longitudinal slot 45, 145 of the intermediate control rod 7, 107, as shown in FIGS. 15 and 23. When it is desired to positively prevent the opening of the movable frame 3, 103 by pivoting about a vertical axis, the movable frame is opened by pivoting same about a horizontal axis and the end 86 of control member 84 (FIG. 28) is introduced into the slot 80, 180 of locking member 8, 108 and subsequently into the groove 72, 172 of safety bolt 69, 169. The control member 84 is caused to rotate in such a way that the rounded ends 74, 174 and 75, 175 will slide along the circular segments 55, 155; 56, 156 of bore 49, 149, so that the longitudinal axis of flat-faced member 73, 173 be aligned in relation to the longitudinal axis 46, 146 of slot 45, 145. Then the locking member 8, 108 is pushed in the direction of the arrow $F_1$ so as to move same through a distance corresponding to the pitch 14, 114, whereby the locking member 8, 108 will be moved to its upper position with respect to the longitudinal slot 45, 145 of the intermediate control rod 7, 107, as shown in FIGS. 14, 16, 22 and 24. Then, the control member 84 is rotated in the other direction so that the flat-faced member 73, 173 of safety bolt 69, 169 will again extend at right angles to the longitudinal axis 46, 146 of longitudinal slot 45, 145. The rounded ends 74, 174 and 75, 175 will slide along the circular segments 53, 153; 54, 154 of bore 48, 148 until the faces 77, 177; 78, 178 of flat-faced member 73, 173 will abute the edges 57, 157 and 58, 158 of bore 48, 148 formed in the longitudinal slot 45, 145 of the intermediate control rod 7, 107. Thus, the safety bolt 69, 169 is in its locked position. It is only after this rotational movement that it becomes possible to remove the movable control member or key 84. Under these conditions, the locking member is positively held in its proper position and this position cannot be modified without using the control member or key 84.

Figure 13:
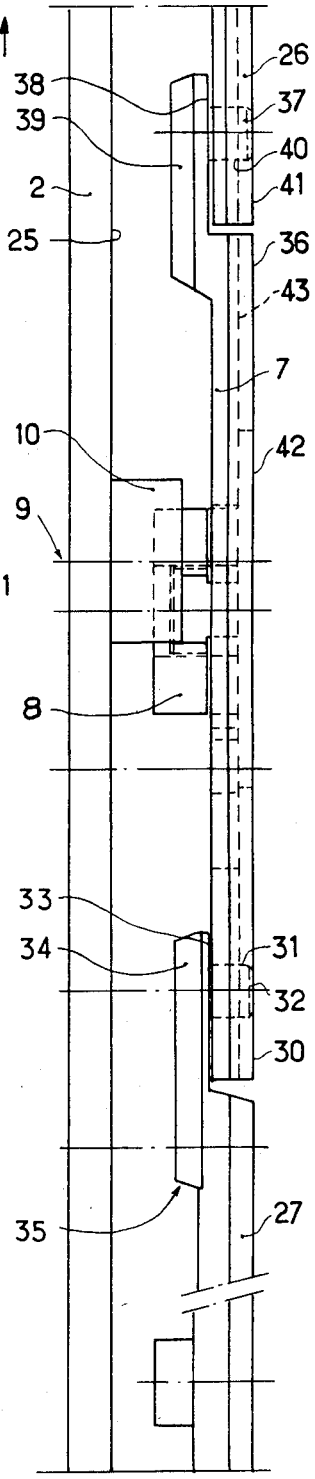
Figure 14:
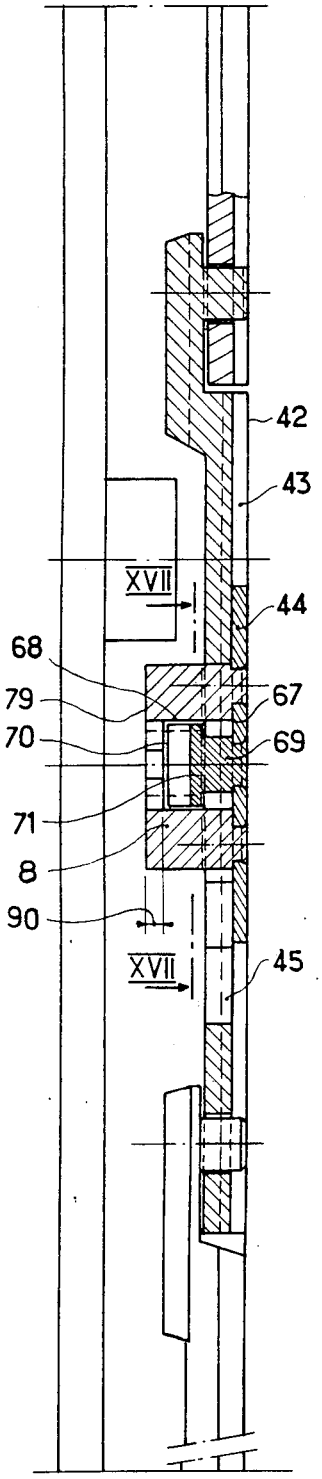

By rotating the handle, the complete set of control rods 7, 107; 26, 126 and 27, 127 is moved, so that the locking member 8, 108 will engage the keeper 10, 110, as shown in FIGS. 13 and 20.

I claim:

1. Window or French-window fitting operable by means of a single handle permitting of setting the fitting in a locked position and two window opening positions, said fitting, disposed between the fixed frame and the movable frame of the window, comprising at least one locking member rigid with a control rod disposed on one of said frames and adapted to be moved by means of said single handle through a distance corresponding to two successive pitches, and at least one keeper adapted to be engaged by said locking member and disposed on the other frame, this fitting comprising on the one hand at least one locking means, consisting of said locking member and said keeper, one of which being adapted to be moved through the distance of one pitch by actuating said control rod in the normal direction of travel of said control rod and on the other hand a safety device adapted to lock said locking member at the end of its linear translation.

2. The fitting of claim 1, wherein the movement of one of the component elements, locking member or keeper, of said locking means, is a movement obtained by transposition.

3. The fitting of claim 1, wherein, for transposing said locking member or said keeper of said locking means, there are provided in said control rod two fixing recesses of which the relative distance corresponds to one pitch of movement of said control rod.

4. The fitting of claim 1, wherein the movement of one of said locking member or said keeper of said locking means is a linear translation.

5. The fitting of claim 4, wherein, for producing the linear translation of one of said locking member or said keeper of said locking means, an elongated hole is provided, the distance between the two end positions afforded by said elongated hole corresponding to the pitch of said control rod.

6. The fitting of claim 1, wherein the movement of one of said locking member or said keeper of said locking means is a 180-degree rotation of said control rod about an axis which is eccentric by a half-pitch.

7. The fitting of claim 1, wherein one of said locking member or said keeper has two locking positions spaced by a distance of one pitch from said control rod.

8. The fitting of claim 1, wherein said movable member is the locking member rigid with said control rod.

9. The fitting of claim 1, wherein said movable member is the keeper.

10. The fitting of claim 1, wherein said safety device comprises a longitudinal slot having its longitudinal axis coplaner with the longitudinal axis of said control rod, said slot being provided with two holes of substantially circular configuration.

11. The fitting of claim 10, wherein said two substantially circular holes have a diameter greater than the width of said longitudinal slot and the distance between centres of said holes corresponds to the movement of one pitch of said control rod.

12. The fitting of claim 10, wherein each hole comprises two circular segments provided with diametrally opposed stop means.

13. The fitting of claim 10, wherein each stop means comprises a wall parallel to the transverse axis of said holes.

14. The fitting of claim 12, wherein said safety device comprises a safety bolt provided with a flat-faces portion having rounded ends concentric to said circular segments.

15. The fitting of claim 14, wherein said rounded ends of said flat-faced portion are positioned on a diameter corresponding to the diameter of said holes.

16. The fitting of claim 14, wherein the two faces of said flat-faced portion are adapted to cooperate with said walls of said stop means in order to limit the rotational movement of said safety bolt and set said flat-faced portion at right angles to the longitudinal axis of said longitudinal slot.

17. The fitting of claim 14, wherein said flat-faced portion has a width corresponding to the width necessary to permit the movement of trahslation of said safety bolt and consequently of said locking member.

18. The fitting of claim 14, wherein said safety bolt adapted to rotate freely but rigidly movable with said locking member comprises on its front face a groove permitting the introduction of a control member or key for changing if necessary the position of said safety bolt.

19. The fitting of claim 14, wherein said safety bolt comprises a locked position and a release position to permit the translation of said locking member.

20. The fitting of claim 14, wherein said locking member rigid with a slide comprises in its rear face a recess in which said safety bolt is disposed.

21. The fitting of claim 14, wherein said locking member comprises on its front face a slot registering with said groove formed in the front face of said safety bolt and opening into said recess formed in the rear face of said safety bolt.

22. The fitting of claim 21, wherein said slot comprises a hole having a diameter greater than the width of said slot.

23. The fitting of claim 22, wherein said control member has a portion of a width corresponding to the length of said slot and a thickness corresponding to the width of said slot.

24. The fitting of claim 21, wherein said control member comprises at its outer end a restricted portion of a width slightly smaller than the diameter of said hole and a height slightly greater than the thickness of the section disposed between said recess and said front face of said locking member.

* * * * *